US006418763B1

(12) United States Patent
Huang

(10) Patent No.: US 6,418,763 B1
(45) Date of Patent: Jul. 16, 2002

(54) ELECTRONIC CHIP FUNCTIONED LOCK

(76) Inventor: Tsun Thin Huang, 6F, No. 3, Alley 10, Lane265, Sec. 4, Hsin-I Rd., Taipei (TW)

( * ) Notice: Subject to any disclaimer, the term of this patent is extended or adjusted under 35 U.S.C. 154(b) by 24 days.

(21) Appl. No.: 09/760,765

(22) Filed: Jan. 17, 2001

(51) Int. Cl.[7] ..... E05B 47/02

(52) U.S. Cl. ..... 70/278.7; 70/278.2; 70/279.1; 70/280; 292/39; 292/144

(58) Field of Search ..... 70/278.7, 278.2, 70/279.1, 280, 281, 282; 292/39, 142, 144

(56) References Cited

U.S. PATENT DOCUMENTS 4,656,850 A * 4/1987 Tabata ..... 292/144
4,833,465 A * 5/1989 Abend et al. ..... 292/144
5,083,448 A * 1/1992 Karkkainen et al. ..... 292/144
5,199,288 A * 4/1993 Merilainen et al. ..... 292/144
5,791,179 A * 8/1998 Brask ..... 292/142
5,946,955 A * 9/1999 Suggs et al. ..... 70/218

* cited by examiner

*Primary Examiner*—Lynne H. Browne
*Assistant Examiner*—Christopher Boswell
(74) *Attorney, Agent, or Firm*—Troxell Law Office PLLC

(57) ABSTRACT

An electronic chip functioned lock whose tongue piece revolving mechanism is either manually operatable with a mechanical key, or by an electronic chip attached key. The lock mechanism is connected to a computer for reading input information to confirm the code stored in the chip so as to avoid unauthorized entry, and to amend, store, or erase the data in case of need. The computer can further be interconnected to a local security system.

7 Claims, 8 Drawing Sheets

ELECTRONIC CHIP FUNCTIONED LOCK

BACKGROUND OF THE INVENTION

1. Filed of the Invention

The present invention relates to an electronic chip functioned lock, in particular, a lock whose tongue piece revolving mechanism is manually operatable with a handle, on the other hand, the locking mechanism is operatable by an electronic code chip attached key. The lock mechanism can be connected to a computer for reading input information to identify the code so as to avoid unauthorized entry, and to amend, store, or eliminate the stored data in case of need.

2. Description of the Prior Art

As it is well known to us, there are many kinds of door locks for your selection. Among those locks, the commonest one is shown in FIGS. 1 through 3. As shown in these figures, a key 9 is inserted into a key hole 90 to turn a turnable strap 91 which inturn actuate rear portion of a latch 92 so as to cause retraction of latch 92 thereby unlocking the door lock. In such a conventional door lock, the key 9 is provided with a planar sinuously curved edge for unlocking. But the key 9 formed in this version is easy to be duplicated. Then an improvement was made to provide a semicylindrical shaped key fashioned for a while on the market. However, it is soon unable to withstand natural selection as this key similarly depends on the turnable strap 91 to actuate the latch so that the above mentioned shortcoming still exists. Then shortly afterwards, there appeared so called multistaged lock appeared on the market, its accompanied key 9 forces the turnable strap 91 to cause the latch 92 retracting step by step. Such a round rod shaped key 9 has a plurality of punched circular recesses thereon alighned to mate with the protuberances correspondingly provided on the turnable strap 91 so as to turn the latter and unlock the lock. Also a multistaged lock is somewhat sophisticated in construction than the other two previous ones, but an user can not be free from the fear of loosing one's key that causes he/she to spend considerably long time to duplicate a new key. Recently, there appeared a press button type coded lock by pressing the coded buttons on the face board of the lock to release the latch, but this lock does not work during electrical power outage. Besides, it is vulnerable and easy to be insecurely decoded.

A lock is usually installed that the latch is engaged between a door frame and a door pillar whereat the lock is easy to be broken by intruders. In addition, average persons have to usually carry a plurality of keys for locks installed on the plurality of doors of their housing and offices when they are going out. Of course, everybody dislikes to always so inconveniently carry a strings of keys when going out.

In view of the foregoing situation, the inventor of the invention herein conducted intensive research based on many years of experience gained through professional engagement in the manufacturing of related products, with continuous experimentation and improvement culminating in the development of the improved structure of electronic chip functioned lock.

SUMMARY OF THE INVENTION

It is an object of the present invention to provide an electronic chip functioned lock having a tongue piece revolving mechanism which is manually operatable with a handle, on the other hand, the lock mechanism is operatable by an electronic chip attached key, and interconnected to a computer for reading input information to check and identify the code so as to avoid unauthorized entry caused by misunlocking, and to amend, correct, or eliminate the stored data in case of need.

To achieve the above mentioned object, the electronic chip functioned lock comprises a main lock body, an inductor unit, a tongue piece revolving mechanism, and a locking mechanism. Wherein the lock body further includes a front and a rear lock covers, and a front and a rear handles. An inductor of the inductor unit is mounted on the upper inner surface of the front lock cover, a circuit board and a battery unit are connected to the inductor which can be mate with the chip attached key to actuate the locking mechanism. The locking mechanism further includes a locking number, an axially disposed motor operated pinion and rack unit, a turnable connecting rod, and a pair of micro switches. When the code output from the electronic chip on the key is identified to be correct, the locking mechanism is actuated and releases the latch to unlock. The interconnected computer can be used to amend, correct, or eliminate the stored data in case of need. Besides, the lock can also be unlocked manually by the key without the aid of the chip function.

BRIEF DESCRIPTION OF THE DRAWINGS

To enable a further understanding of the innovative and technological content of the invention herein, refer to the detailed description of the invention and the attached brief description of the drawings appended below in which.

DETAILED DESCRIPTION OF THE PREFERRED EMBODIMENT

Figure 1:
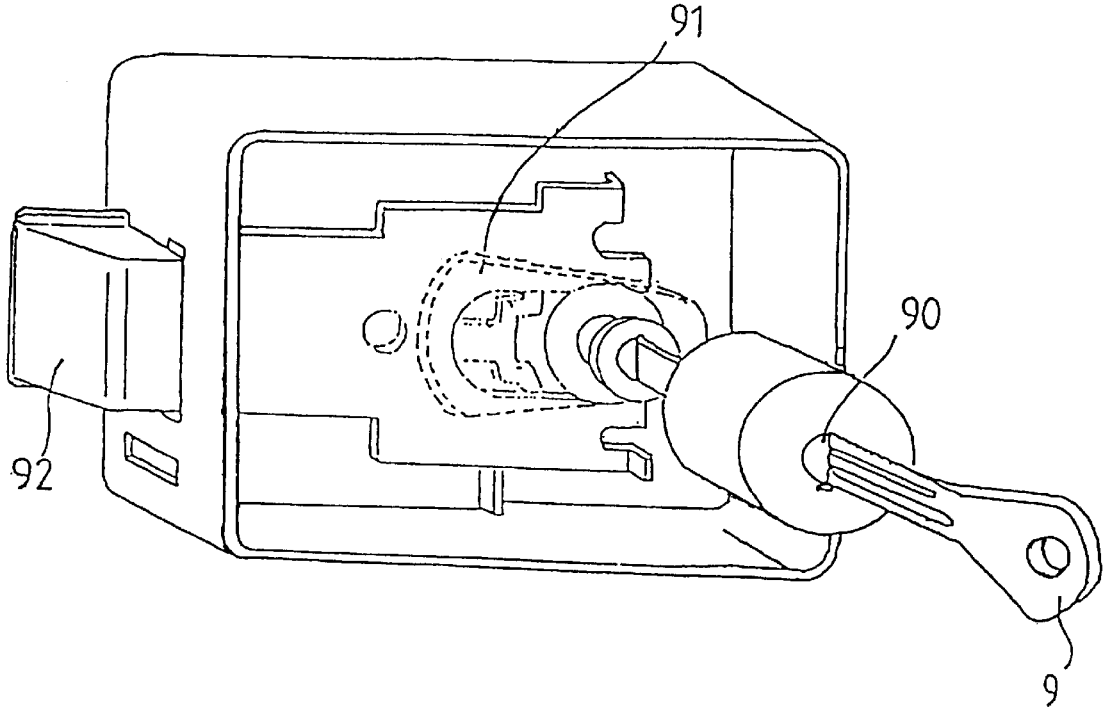
FIG.1 ( PRIOR ART )
FIG. 1 is a three dimensional view of a conventional door lock with its key showing the state before unlocking.
Figure 2:
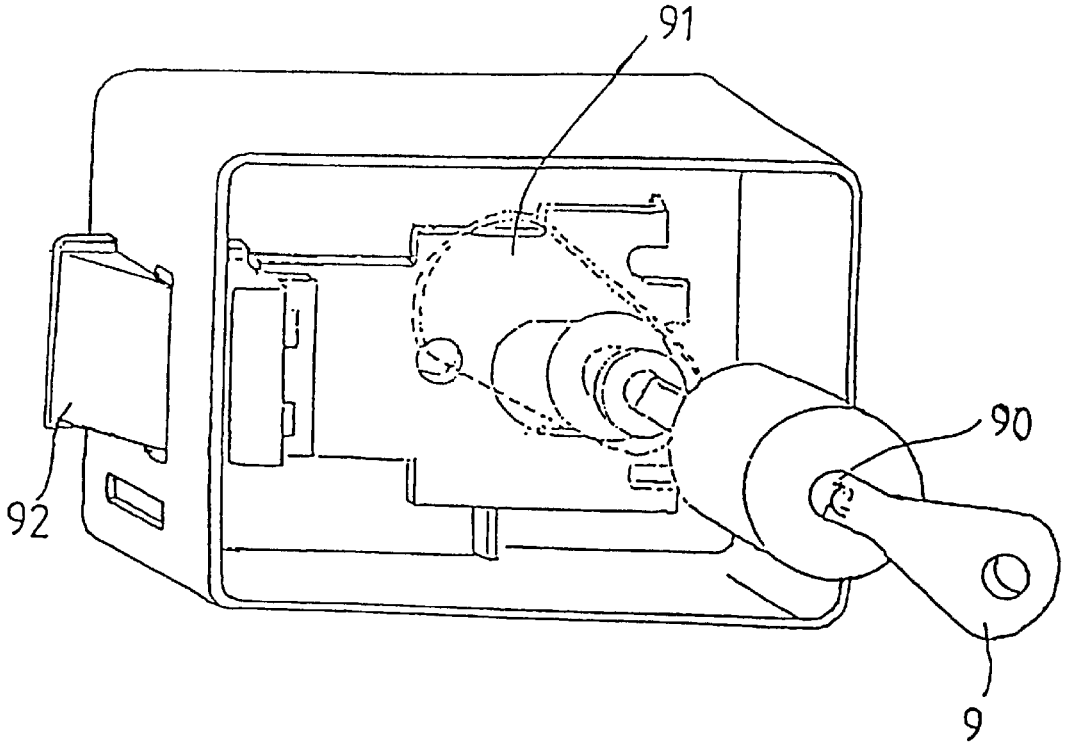
FIG.2 ( PRIOR ART )
FIG. 2 is a three dimensional view of a conventional door lock with its key showing the state that the door lock is under unlocking.
Figure 3:
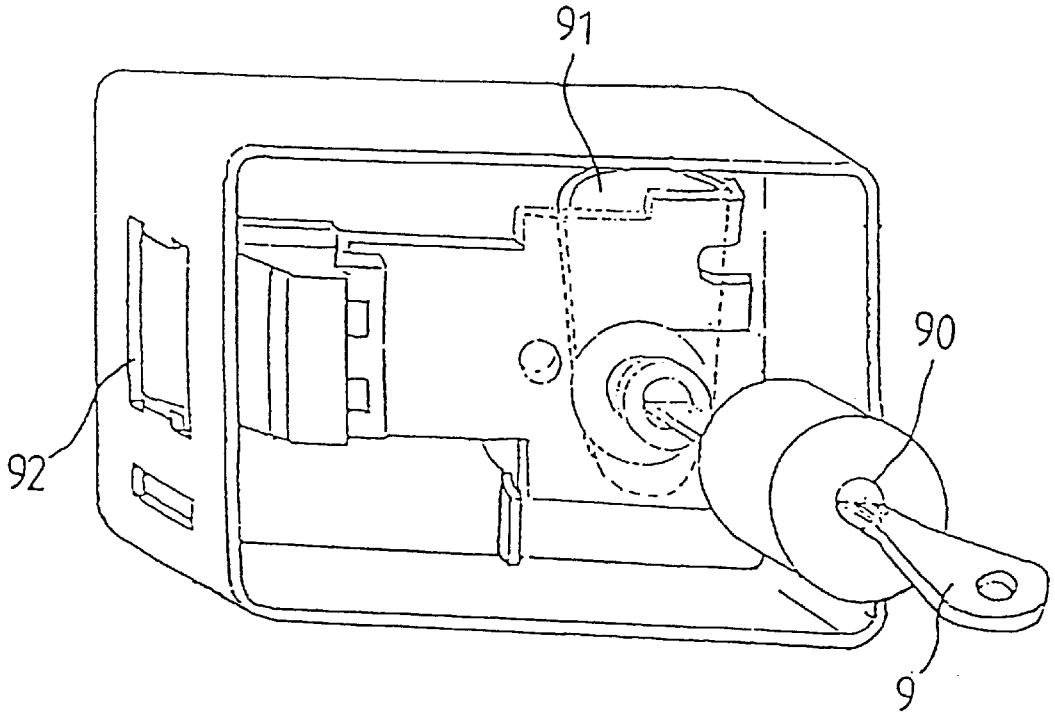
FIG.3 ( PRIOR ART )
FIG. 3 is a three dimensional view of a conventional door lock with its key showing the state before unlocking.
Figure 4:
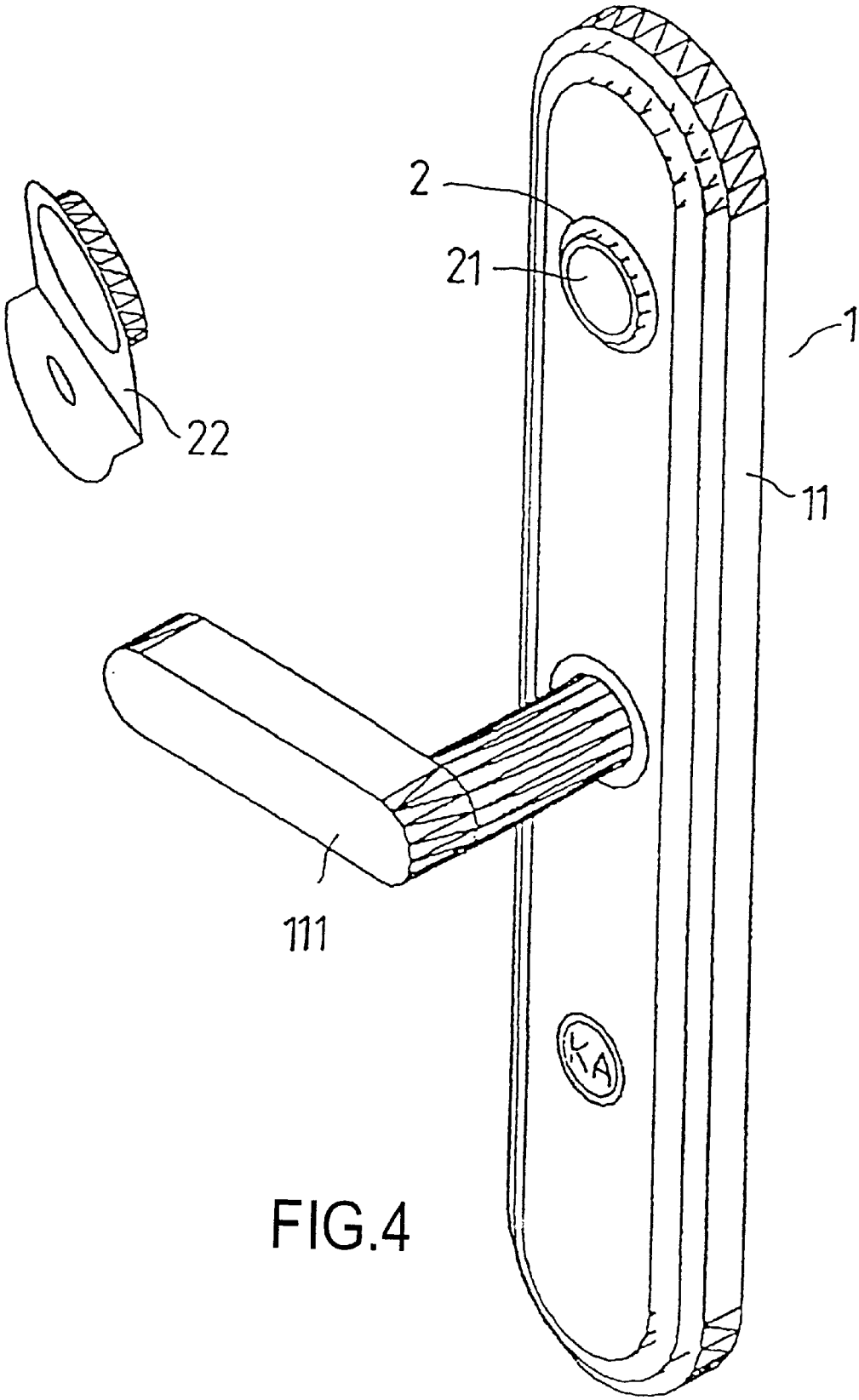
FIG. 4 is a three dimensional fragmentary view of the present invention.
Figure 5:
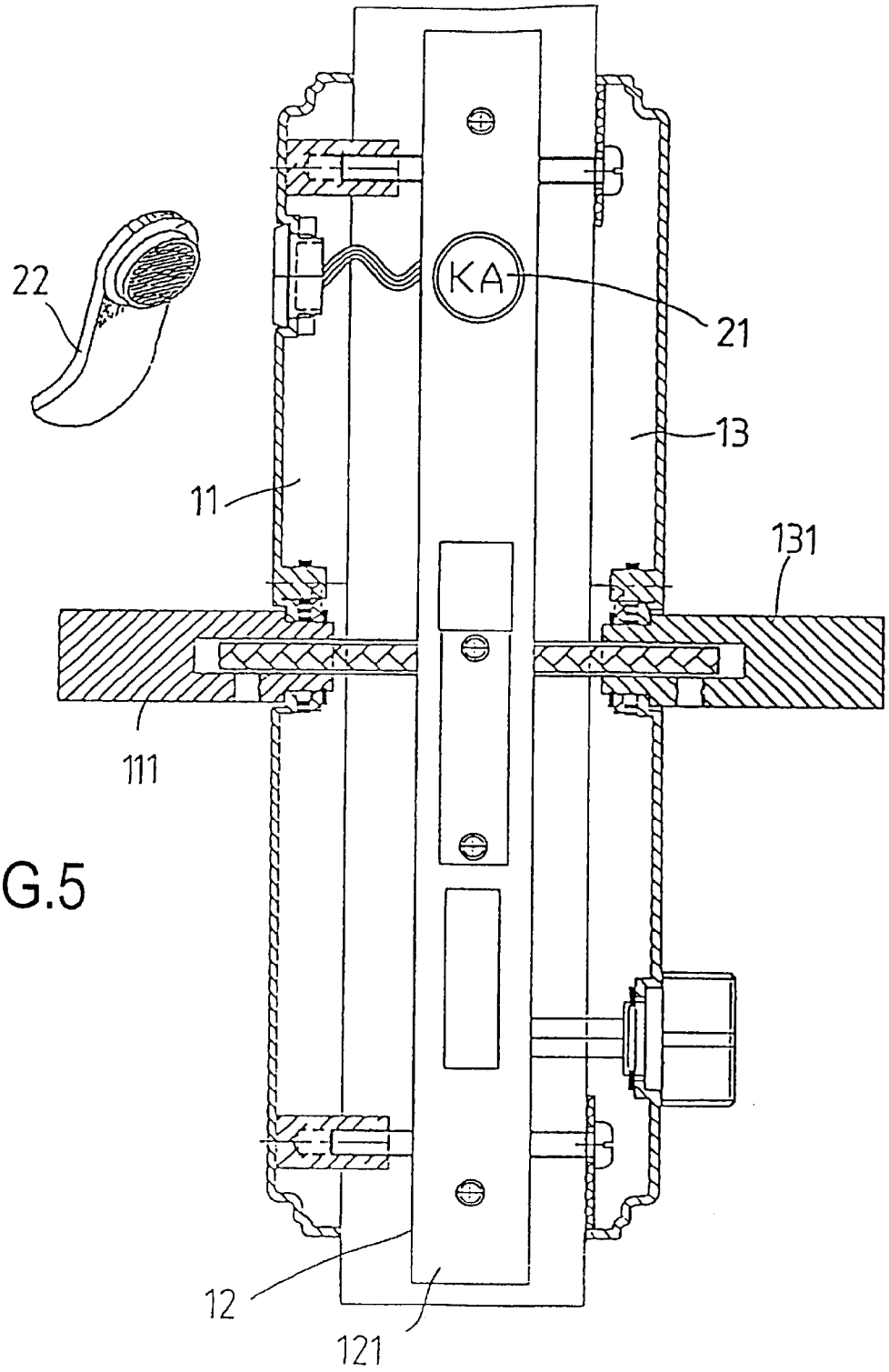
FIG. 5 is a side sectional view of the present invention.
Figure 6:
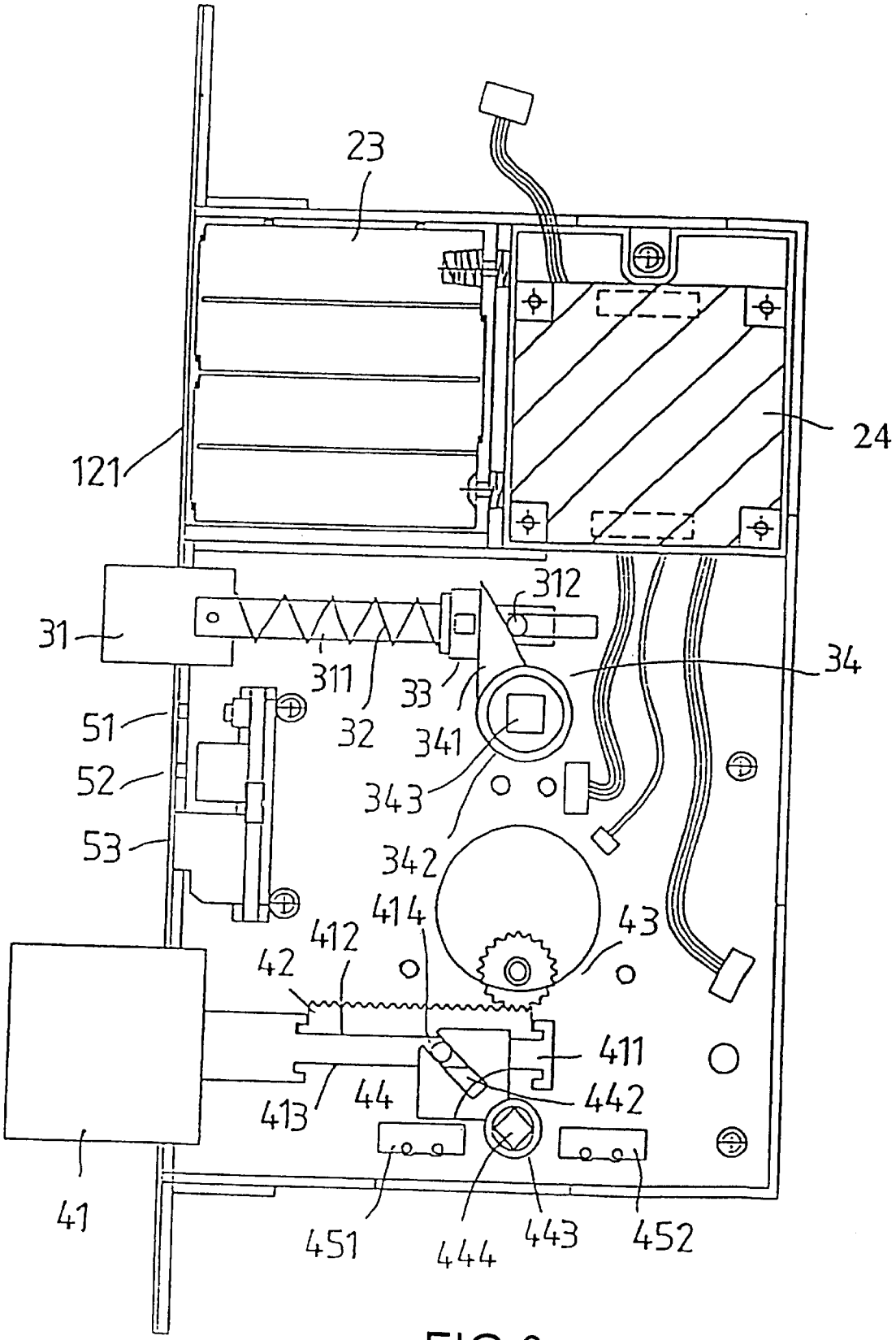
FIG. 6 is an interior perspective view of the present invention in locked state.

Referring to FIGS. 4 to 6, the electronic chip functioned lock of the present invention comprises a main lock body 1, an inductive unit 2, a tongue piece revolving, mechanism 3, and a locking mechanism 4. The inductive unit 2 having an inductive 21 is mounted on a front cover 11 of the main lock body 1. The inductor 21 mates with an electronic chip attached key 22 to check if the input code is correct to unlock. A front handle 111 is equipped on the middle portion of the front cover 11.

Referring again to the FIG. 5, the main lock body 1 include the front cover 11, a middle lock housing 12, and a rear cover 13, a rear handle 131 is provided on the rear cover 13 at the position corresponding to the front handle 111. A circuit board 24, a battery unit 23, the tongue piece revolving mechanism 3, and the locking mechanism 4 (see FIG. 6) are accommodated in the middle lock housing 12, the circuit board 24 is connected to the inductor 21.

Referring again to FIG. 6, the tongue piece revolving mechanism 3 includes a tongue piece 31, a restraining spring 32, a stationary base 33, and a revolving member 34. The tongue piece 31 tunnels through a front cover plate 121 of the middle lock housing 12 and has a conical front end. A connecting rod 311 encompassed by the restraining spring 32 is hinged to the rear end of the tongue piece 31 and passes through the stationary base 33 mounted behind it so as to fix the spring 32 between the stationary base 33 and the rear end of the tongue piece 31. There is a post 312 emerging upward and downward installed at the terminal of the connecting rod 311 is able to follow movement of the revolving member 34. There are threads on the outer surface at the middle section of the post 312 so as to be screw combined with the connecting rod 311 thereby facilitating coupling the two parts together or separating them apart. In this way, the direction of the sloped surface of the tongue piece 31 is adjustable able to be installed in a door lock with a right handed or left handed door handle, and for either inwardly opened or outwardly opened door.

The revolving number 34 has a dual parallely bladed claw 341 urging on both sides of the post 312 emerging upward and downward; one end of the claw 341 has a cylinder 342 sleeved into a set hole provided on the main lock body 1 such that the cylinder 342 is freely rotatable therein. A square hole 343 is formed at the upper end of the cylinder 342 so that the axle of the handles 111, 131 can be inserted thereinto so as to drive the tongue piece revolving mechanism 3.

The locking mechanism 4 includes a locking member 41, a motor operated pinion and rack unit 43 installed at the rear end of the locking member 41 with a row of serration 42 formed on the rack, a follower 44 and a pair of micro switches 451, 452. The locking member 41 which can freely enter and retract from the middle lock housing 12 is in rectangular shape and has an elongated damper 411 at its rear end thereof for guiding the serration 42 of the rack with two narrow slots 412 and 413 formed at both sides of the elongated damper 411. A post 441 is further formed on the clamper 411 and is clamped and driven by the follower 44. An U shaped breach 442 is formed at the center of the follower 44 for clamping the post 444 and a sleeve 443 provided at the terminal of the follower 44 is sleeved into a set hole prepared on the main lock body 4 to be freely rotatable therein. Moreover, a square hole 444 is provided on the upper end of the sleeve 443 for insertion of an axle of the handle.

The pair of micro switches 451, 452 which having the ability of interrupting and changing over the circuit are disposed respectively at both sides of the follower 44 and are actuated by the follower 44 traveling back and forth. The micro switches 451, 452 are also able to detect if the locking member 41 has reached its relevant position when locking or unlocking.

Furthermore, they are communicated with an alarm circuit installed on the circuit board so as to deliver alarm sound for warning in case of an emergency occurrence.

Besides, a reset insert hole 51, a computer insert hole 52, and a buzzer insert hole 53 are provided on the center portion of a side cover of the main lock body 4 for resetting a chip for the lost key. A computer is connected to the computer insert hole 52 for reading the input data from the chip and performing necessary filing, amendment or erasing if any. The computer can further be interconnected to a local security system to enhance the security of the user's building.

FIG. 6 shows the state that the input data on the chip do not match the preset code, so that the lock is kept in closed state.

Figure 7:
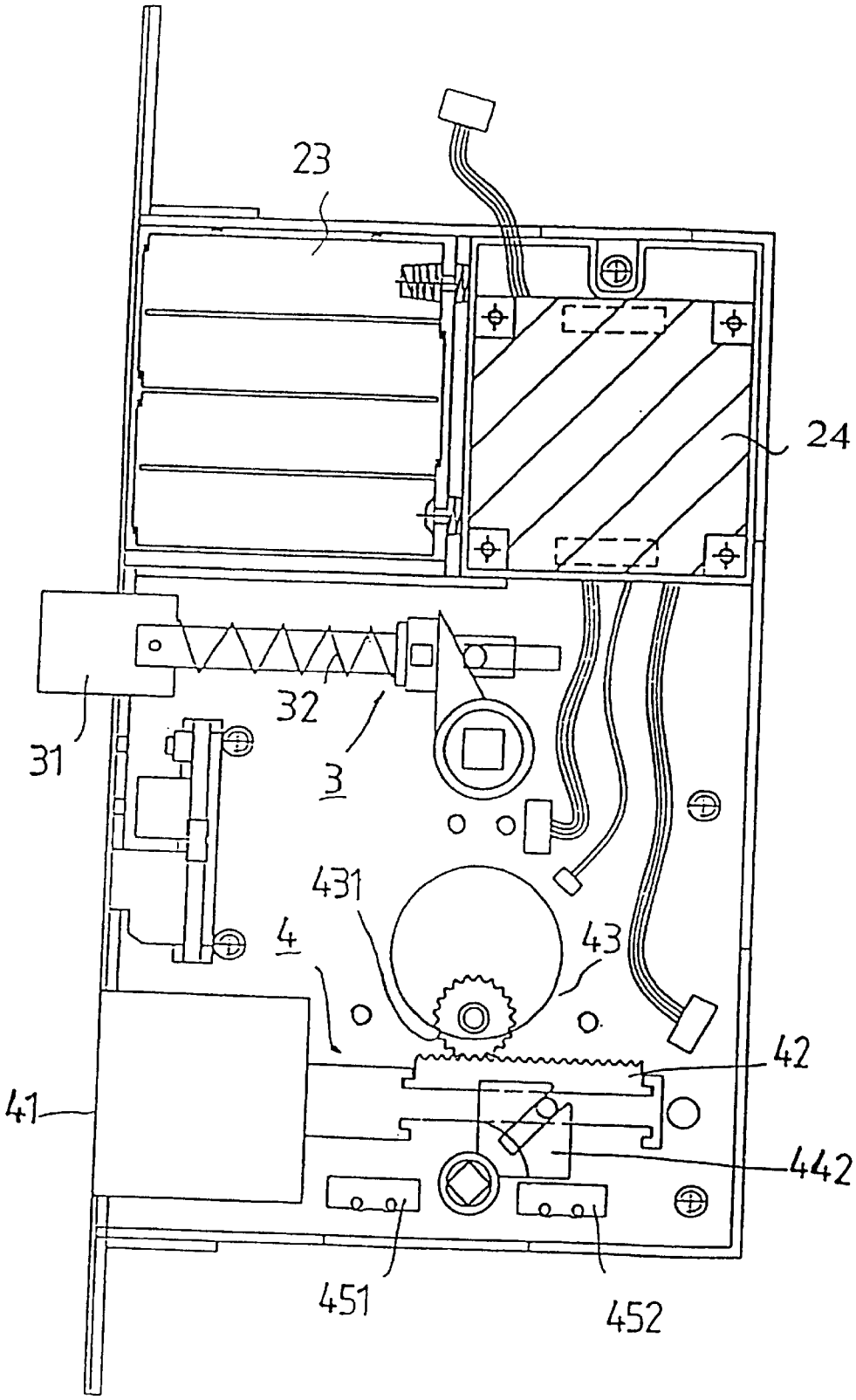
FIG. 7 is an interior perspective view of the present invention where the locking mechanism is on the way to unlock after the code is confirmed by the computer.

FIG. 7 shows the state that the inductor 21 identify that the input data supplied by the chip attached key 22 concides with the preset code. In this case, an output signal is delivered to the motor operated pinion and rack unit 43 to actuate the unit 43 thereby driving the elongated damper 411 and the locking member 41 to retract.

Figure 8:
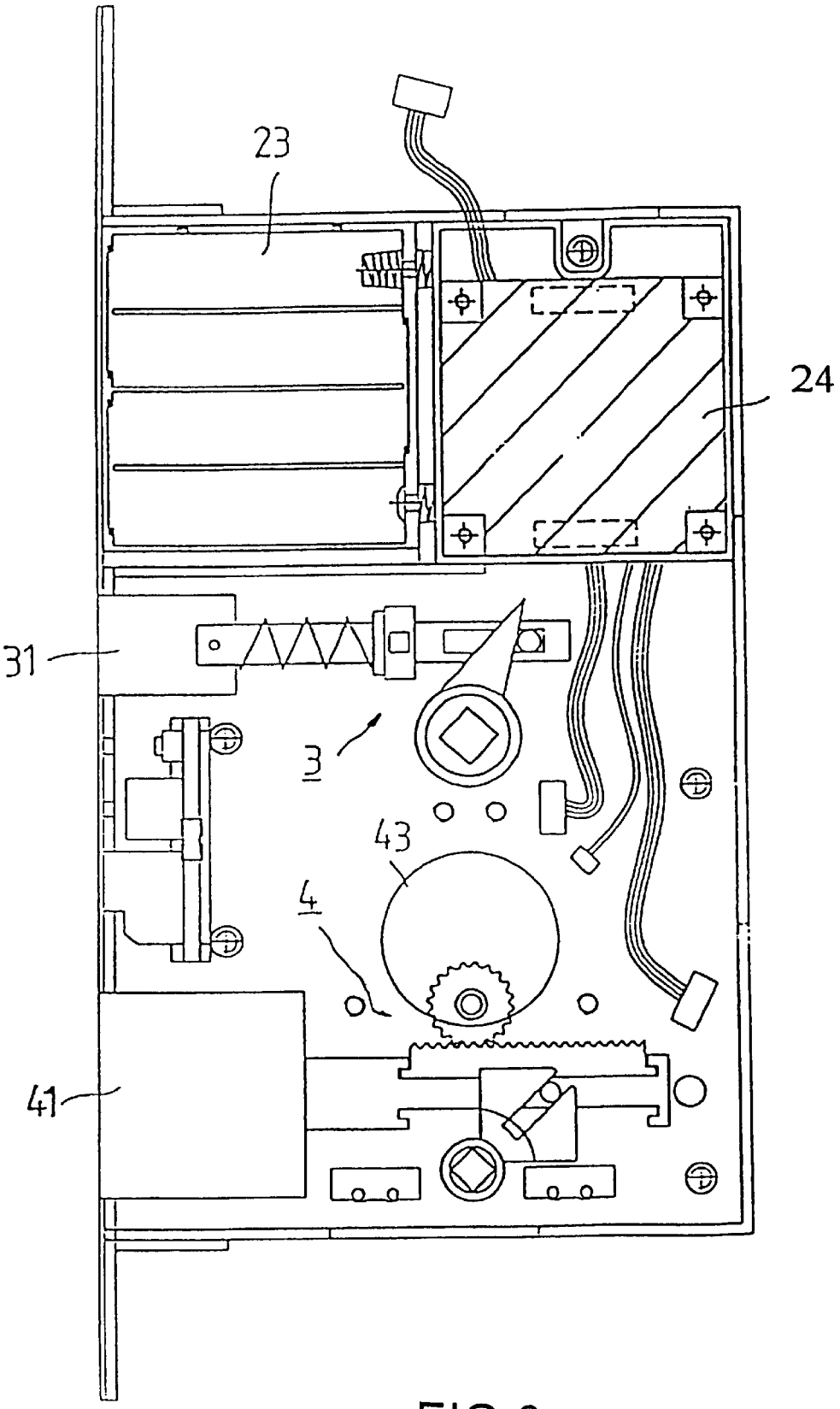
FIG. 8 is an interior perspective view showing the lock latch is released.

FIG. 8 shows the state continued from that shown in FIG. 7, until the locking member 41 is completely retreated into the main lock body 4, and simultaneously the follower 44 actuate the micro switch 45 to interrupt electricity. Immediately after that, the user may turn the rear handle 131, and the revolving member 34 is turned and drives the connecting rod 311 and the tongue piece 31 to retract so as to open the lock.

In the emergency, persons in the building are able to open the door from inside by manually turning the handle to release the latch without using the electronic chip attached key In the present invention, the electronic chip attached key employed belongs to an information button key, it is optionally selective from 32 bit, 48 bit, 54 bit, 64 bit or 128 bit code permutation so that there are approximately more than $100\times10^6$ combinations. The number of duplicated keys and the entry record to the building can be effectively controlled by the computer management.

It reveals from the description of the above embodiment that the invention is noteworthly advantageous that the lock of the present invention is so elaborately designed that it is simply constructed, easy for handling, difficult to decode or duplicate a key. In addition, it can be connected to a computer for reading input data to confirm the code stored in the chip so as to avoid unauthorized entry, and to amend, store, or erase the data in case of need.

Those who are skilled in the art will readily perceive how to modify the invention. Therefore, the appended claims are to be constructed to cover all equivalent structures which fall within the true scope and spirit of the invention.

What claimed is:

1. Electronic chip functioned lock comprising: a main lock body, a tongue piece revolving mechanism, and a lock mechanism, wherein, the main lock body further including a front cover, a middle lock housing, and a rear cover, a front handle and a rear handle being provided respectively at relevant positions on said front cover and said rear cover corresponding to each other, a circuit board, acid a battery unit, said tongue piece revolving mechanism, and said locking mechanism being accommodated in said middle lock housing;

said tongue piece revolving mechanism including a tongue piece, a retaining spring, a stationary base, and a revolving member, said tongue piece extending through a front cover plate of said middle lock housing, a connecting rod encompassed by said restraining spring being hinged to the rear end of said tongue piece and passing through said stationary base so as to fix said spring between said stationary base and the rear end of said tongue piece, a post installed at the terminal of said connecting rod being able to follow movement of said revolving member;

said lock mechanism further including a locking member, a motor operated pinion and rack unit installed at the rear end of said locking member with a row of serrations formed on the rack, a follower, and a pair of micro switches, wherein said locking member being able to freely enter and retract from said middle lock housing through its front cover plate and having a damper at its rear end thereof for guiding said serrations of the rack with two narrow slots formed at both sides of said clamper so as to drive said serrations of the rack by aid of a motor operated pinion and rack unit, a post being further formed on said damper and being driven by said follower, and sleeve provided at the terminal of said follower being sleeved into a set hole prepared on said main lock body to be freely rotatable therein, a square hole being provided on the upper end of said sleeve;

the movement of said lock mechanism is controlled by said tongue piece revolving mechanism, when stored code in the chip attached on a key is identified to be coincident with the preset code, an electronic circuit on said electronic circuit board actuates said motor operated pinion and rack unit to drive the rack and said locking member to displace forward and backward and said post on said clamper moves along with said follower to touch and actuate either one of said micro switches thereby interrupting electricity, said micro switches being capable of detecting when said locking member has reached its relevant position when locking or unlocking.

2. The lock of claim 1, wherein said pair of micro switches are disposed respectively at two sides of said follower.

3. The lock of claim 1, wherein a reset hole, a computer insert hole, and a buzzer insert hole are provided on the center portion of a side surface of said main lock body for resetting a chip code for the lost key, a computer is connected to said computer insert hole for reading the input data from the chip and performing necessary filing, amendment, or erasing if any, said computer can be interconnected to a local security system to enhance security of the user's building.

4. The lock of claim 1, wherein said post at the terminal of said connecting rod is threaded at the outer surface of the middle section so as to be screw engageable or detachable from said connecting rod thereby causing the direction of a sloped surface on said tongue piece is to be adjustably installed in a door lock with a right handed or left handed door handle, and for either an inwardly opened or an outwardly opened door.

5. The lock of claim 1, wherein said revolving member has a dual parallely bladed claw urging on both sides of said post at the terminal of said connecting rod, one end of said claw has a cylinder sleeved into a set hole provided on said main lock body such that said cylinder is freely rotatable therein, a square hole is formed at the upper end of said cylinder so that said handles can be inserted thereinto so as to drive said tongue piece revolving mechanism.

6. The lock of claim 1, wherein an U shaped breach is formed at the center of said follower for clamping said post installed on said clamper.

7. The lock of claim 1, wherein said pair of micro switches is further communicative with an alarm circuit on the circuit board so that an alarm sound will be delivered in case of an emergency.

* * * * *